US005531263A

United States Patent [19]

Yamamoto et al.

[11] Patent Number: 5,531,263

[45] Date of Patent: Jul. 2, 1996

[54] OSCILLATING TROUGH FOR SHOT BLAST

[75] Inventors: Masatoshi Yamamoto, Hoi; Mitsuo Matsuba; Hideaki Kaga, both of Toyokawa; Masaki Shibata, Toyohashi, all of Japan

[73] Assignee: Sintokogio, Ltd., Aichi, Japan

[21] Appl. No.: 319,430

[22] Filed: Oct. 6, 1994

[30] Foreign Application Priority Data

| | | | |
|---|---|---|---|
| Oct. 8, 1993 | [JP] | Japan | 5-277501 |
| Feb. 4, 1994 | [JP] | Japan | 6-032879 |
| Mar. 4, 1994 | [JP] | Japan | 6-059868 |

[51] Int. Cl.[6] ..... B24C 3/26

[52] U.S. Cl. ..... 164/404; 164/269; 451/86

[58] Field of Search ..... 164/269, 404; 451/85, 86, 32

[56] References Cited

U.S. PATENT DOCUMENTS

| | | | |
|---|---|---|---|
| 4,254,592 | 3/1981 | Berna et al. | 51/423 |
| 4,319,624 | 3/1982 | Weis et al. | 164/401 |
| 4,757,648 | 7/1988 | Carpenter et al. | 164/404 |

FOREIGN PATENT DOCUMENTS

| | | |
|---|---|---|
| 049404 | 9/1991 | European Pat. Off. . |
| 2424086 | 11/1975 | Germany . |

*Primary Examiner*—Kuang Y. Lin

*Attorney, Agent, or Firm*—Limbach & Limbach; W. Patrick Bengtsson

[57] ABSTRACT

An oscillating trough for shotblasting, which prevents workpieces (W) from being damaged when they are turned over in the trough, is provided. The trough includes a depression (24) defined by two surfaces $X_4$, $X_5$ extending from the bottom (21) of the transfer portion upwardly and outwardly thereby making an inner angle of 80°–100° and an arcuate surface S connected to the top of each surface $X_4$, $X_5$ of the depression. The surface S is an arc in cross section of a radius of 70–100% of the radius of the largest cylinder inscribable in imaginary planes Y and Z each of a predetermined length in cross section, the plane Y at one end intersecting an upper end of the surface $X_4$ or $X_5$ with an external angle of 140°–160°, and the plane Z at one end intersecting the plane Y with an inner angle of 120°–140°.

8 Claims, 4 Drawing Sheets

OSCILLATING TROUGH FOR SHOT BLAST

BACKGROUND OF THE INVENTION

1. Field of the Invention

This invention relates to an oscillating trough for shotblasting in which workpieces are turned over.

2. Description of the Prior Art

Generally, a conventional oscillating trough has a V-shaped bottom with an angle of about 120°. (Refer to U.S. Pat. No. 4,319,624.) When a plate, cube, or the like is treated in this trough, a trough surface that contacts the workpiece must be rotated about 60° to become upright so that the workpiece can be turned over. However, the rotation will bring the workpiece up to a high place. Thus when the workpiece falls therefrom, the impacts generated by hitting the lower surfaces cause problems such as scars, cracks and chippings. Furthermore, the workpieces that have thus fallen slide down along a slope, which is about 30°, and crush against an inner surface of the oscillating trough causing further dents, cracks, breaks, etc.

This invention has been created in view of the drawback, and one of the objects of the invention is therefore to provide an oscillating trough for shotblasting in which workpieces are subjected to substantially less scars, crack, chippings, etc.

Another object of this invention is to provide a reversibly rotating trough in a shotblasting machine that is arranged to decrease crashes between workpieces when they are discharged from the trough.

A further object of this invention is to provide a trough in a shotblasting machine that is arranged so that the angle of rotation and/or speed of rotation can be changed depending on the shape of the workpiece.

SUMMARY OF THE INVENTION

The trough of the invention is substantially less rotated than the conventional one to turn a workpiece over in the trough, so that the lift of the workpiece is minimized. The trough at its bottom is provided with a depression defined by two surfaces which make an internal angle of 80°–100°. When a flat workpiece is charged in the trough, it rests on one of the surfaces of the trough and is subjected to shotblasting. By rotating the trough about 40°–50°, the surface that contacts the workpiece becomes upright so that the surface can turn it over. The depression is connected at both ends to arcuate surfaces onto which the workpiece smoothly falls after it has been turned over in the depression by the rotation of the trough. The other surface is then subjected to shotblasting.

The invention provides an oscillating trough having a workpiece transfer portion where workpieces are turned over and transferred downstream to a workpiece discharging portion, wherein the transfer portion includes: a depression defined by two surfaces $X_4$, $X_5$ extending from the bottom of the transfer portion upwardly and outwardly thereby making an inner angle of 80°–100°; and an arcuate surface S connected to the top edge of each surface $X_4$ or $X_5$ of the depression, the surface S corresponding to a curved plane with a radius in cross section of 70–100% of the radius of the largest cylinder inscribable in imaginary planes Y and Z each of a predetermined length, the plane Y at one end intersecting an upper edge of the surface $X_4$ or $X_5$ with an external angle of 140°–160°, and the plane Z at one end intersecting the plane Y with an tuner angle of 120°–140°.

The angle of rotation and the speed of rotation of the trough may be controlled bv driving means for rotating the trough about its shaft in two directions, means for detecting the angle of rotation and the rotational speed of the trough, and a controller electrically connected to the detecting means and the driving means for controlling the angle of rotation and the speed of the driving means.

The other features and advantages of the trough of the invention will be explained in the detailed description of the preferred embodiments by referring to the accompanying drawings.

DESCRIPTION OF THE PREFERRED EMBODIMENTS

Figure 1:
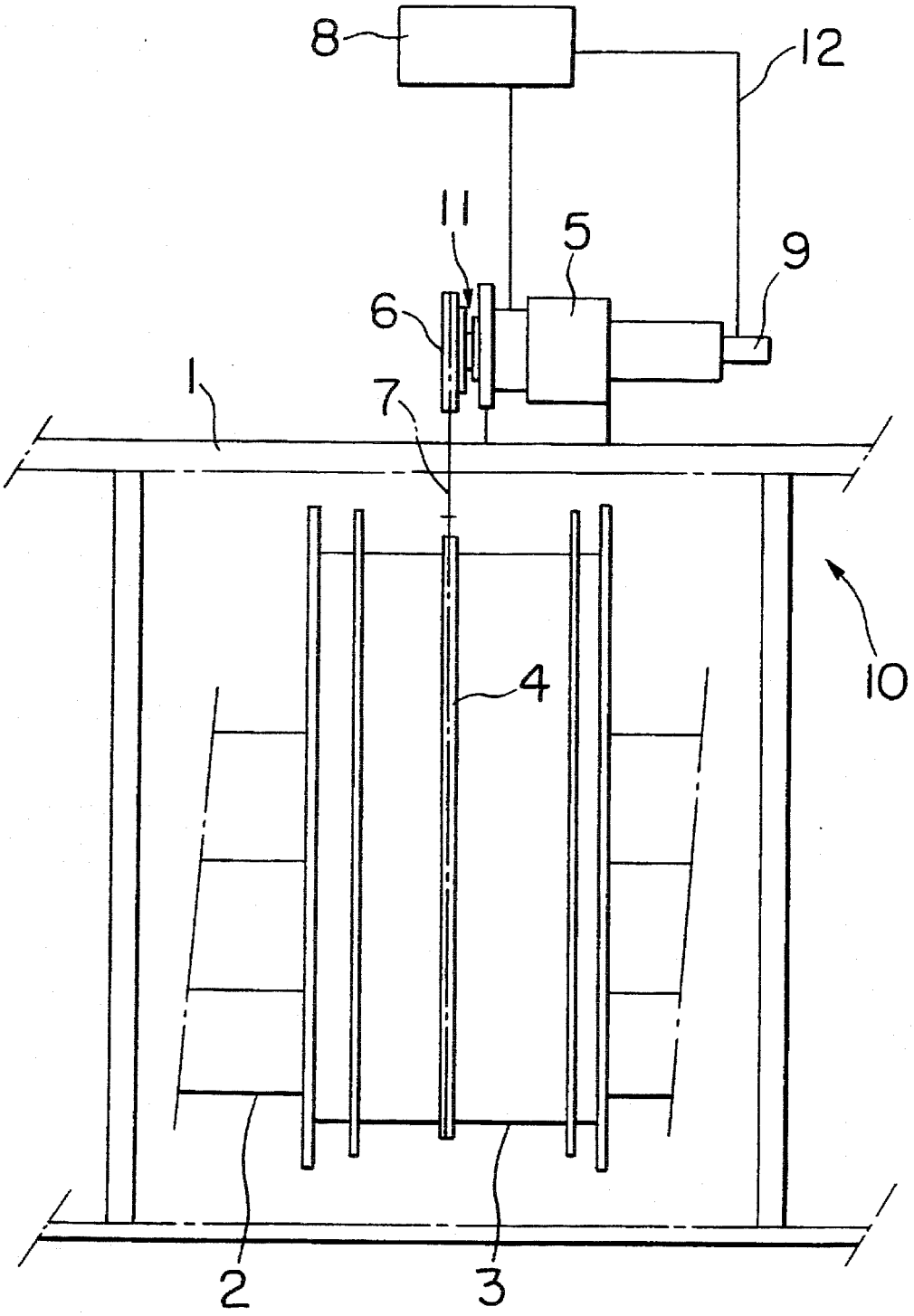
FIG. 1 is a front view of a shotblasting machine provided with an oscillating trough.
Figure 2:
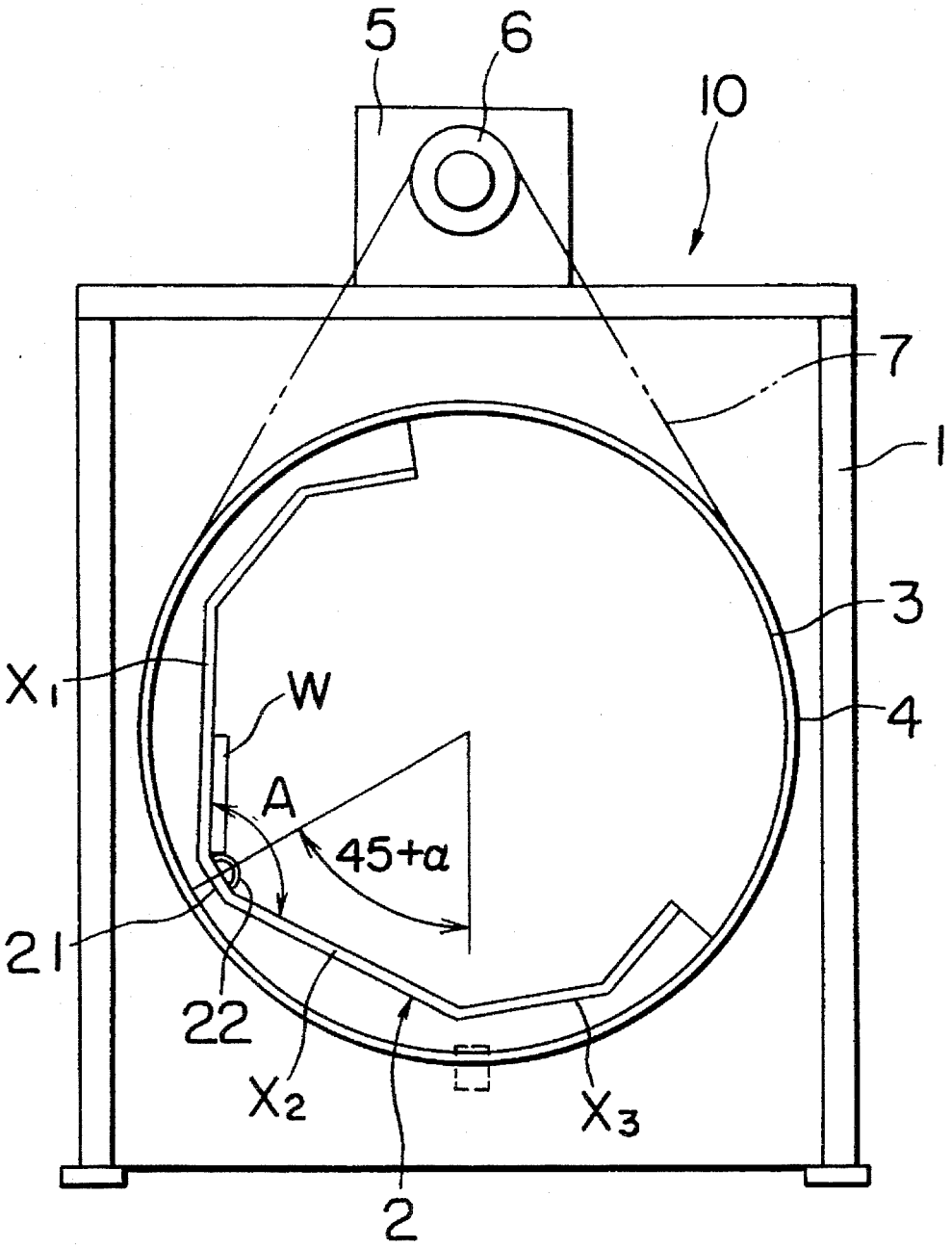
FIG. 2 is a side view of the shotblasting machine of FIG. 1.
Figure 3:
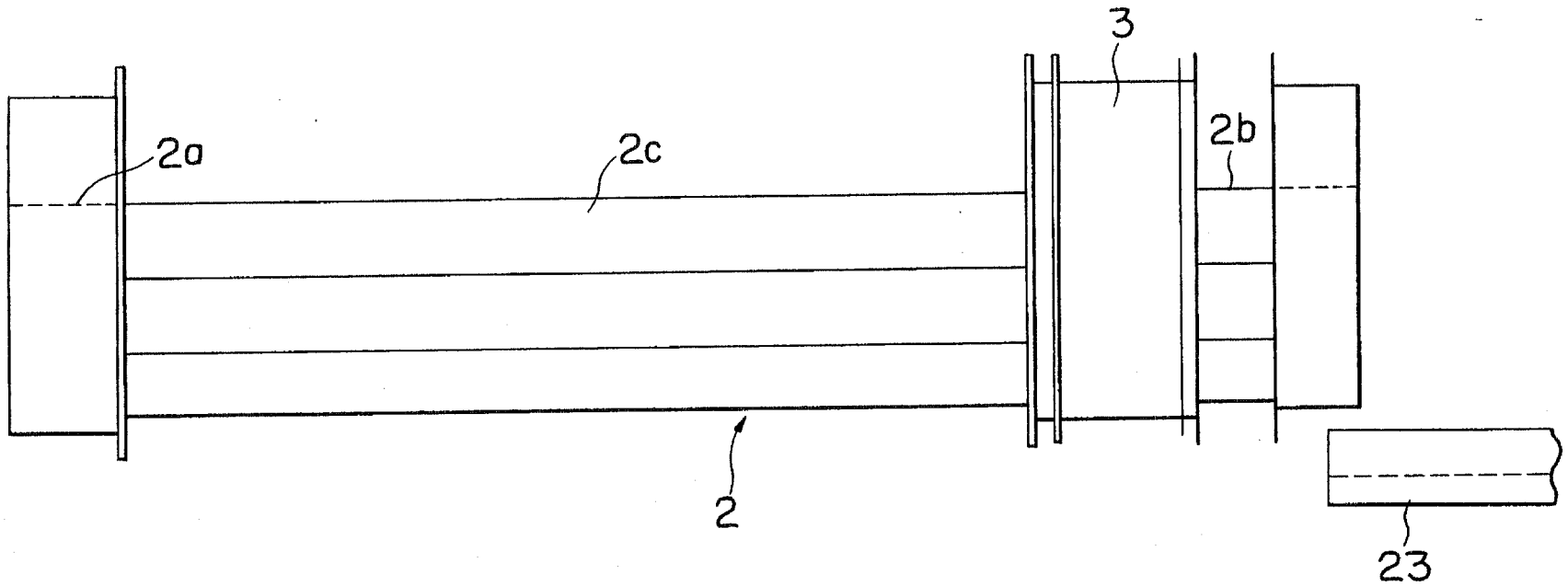
FIG. 3 is a front view of the oscillating trough shown in FIGS. 1 and 2.

In FIGS. 1 and 2 a shotblasting machine 10 is shown. According to one embodiment, the machine is provided with an oscillating trough 2 which includes a workpiece charging portion 2*a*, a workpiece transfer portion 2*c*, and a workpiece discharging portion 2*b* as shown in FIG. 3. The trough 2 is mounted on the inner surface of a drum 3 and extends over its length. The trough is downwardly inclined frown the left end to the right end as viewed in FIG. 3. As the workpiece discharging portion 2*b* is lower than the workpiece charging portion 2*a*, workpieces flow from the left to the right in the trough 2 while being subjected to shotblasting in the transfer portion 2*c*.

The drum 3 which carries the trough 2 is rotatably mounted on the frame 1 of the shotblasting machine 10. A sprocket wheel 4 is mounted on the outer circmnferential surface of the drum 3, while another sprocket wheel 6 is secured to the output shaft 11 of a motor 5 mounted on the top of the frame 1. The motor 5 has reduction gears so that it can change the speed of rotation of the drum 3. The motor can be selectively driven in either direction and the rotation is reversible. A chain 7 is entrained on the sprocket wheels 4, 6. Thus, by rotating the motor 5 in a direction, the drum 3 and the trough 2 can be rotated in a corresponding direction. A controller 8 is electrically connected to the motor to vary the number of rotation per unit time of the motor while it operates. A rotary encoder 9 is operatively coupled to the motor to detect the angle of rotation and the speed of the output shaft 11 of the motor 5, to indirectly detect those of the oscillating trough 2. The detected data are fed back to the controller 8 through a line 12 to control the number of rotation and the speed (from a low to a high speed) of the trough 2. The angle of rotation of the trough that is necessary to turn over workpieces and the angle of rotation of the trough where the rotation is stopped are preset in the controller 8. The means to detect the angle of rotation is not limited to the above but the stone purpose may be attained by such an arrangement as the roller chain 7 operatively connected to a rotary encoder by chains and rotary shafts, or providing a roller on the outer surface of the trough 2 connected to a rotary encoder via rollers and rotary shafts.

FIG. 2 shows the state where the drum 3 and the trough 2 are rotated clockwise through 45°+α by the motor 5. The drawing shows the cross section of the workpiece transfer portion 2*c* of the trough 2. As the trough has been rotated clockwise trough 45°+α, the bottom 21 of the transfer portion 2*c* was moved leftwardly and upwardly, and a surface $X_1$ of the portion 2*c* becomes upright. The cross section of the transfer portion 2*c* of the oscillating trough 2 takes roughly the shape of a U-groove, or in the shape of a section of a polygon with a plurality of bends. A ridge 22 on which the workpiece lies is disposed at the bottom 21 of the trough 2 when it is in the normal position. The angle A defined by two surfaces $X_1$, $X_2$ of the trough, which are adjacent the bottom 21, is preferably 80°–100°. When the angle A is 90° and the trough is rotated through 45° (α=0) as in FIG. 2, the surface $X_1$ becomes vertical.

FIG. 2 shows a workpiece lying on the ridge 22, which acts as a stop, with an untreated surface contacting the surface $X_1$. Then, the drum 3 is further rotated clockwise up to a preset angle of rotation which is sufficient to turn over the workpiece W. When the additional rotation is made, the trough is slowly rotated by controlling the motor thereby minimizing the kinetic energy imparted to the workpiece to prevent the damage. The workpiece, which was turned over, falls on the surfaces $X_2$, $X_3$ of the trough and then settles in a central portion striding over the surfaces $X_2$, $X_3$. At the same time the workpiece gradually travels in the transfer portion 2*c* to the discharging portion 2*b*, driven by the turning-over action and the downward inclination of the trough. During the travel to the portion 2*b*, shots from a projector, which is disposed above the central portion of the surfaces $X_2$, $X_3$, and which is omitted in the drawings, are bombarded on the surface of the workpiece.

The cross section (not shown) of the workpiece discharging portion 2*b* may be circular or semi-circular, or it may have no bend. Thus, when the processed workpiece comes to the discharging portion 2*b*, it is always on the bottom of the trough. The workpiece is then discharged from the portion 2*b* of the trough 2 onto a vibrating conveyor 23. As the workpiece falls from the lowest position of the trough onto the conveyor 23, crashes between treated workpieces can be minimized and, consequently, the damage is minimized.

Figure 4:
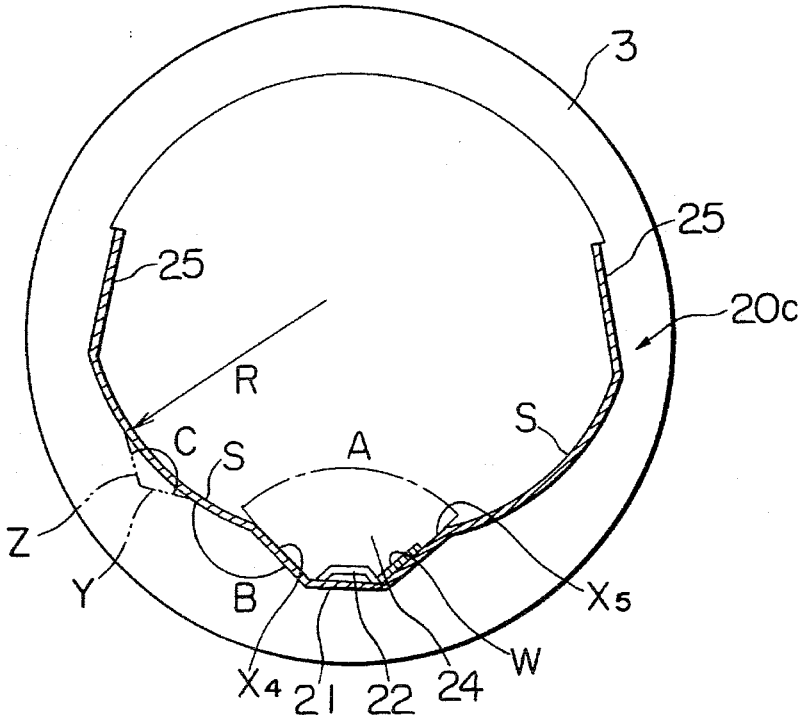
FIG. 4 is a side view of an oscillating trough of the invention.
Figure 5:
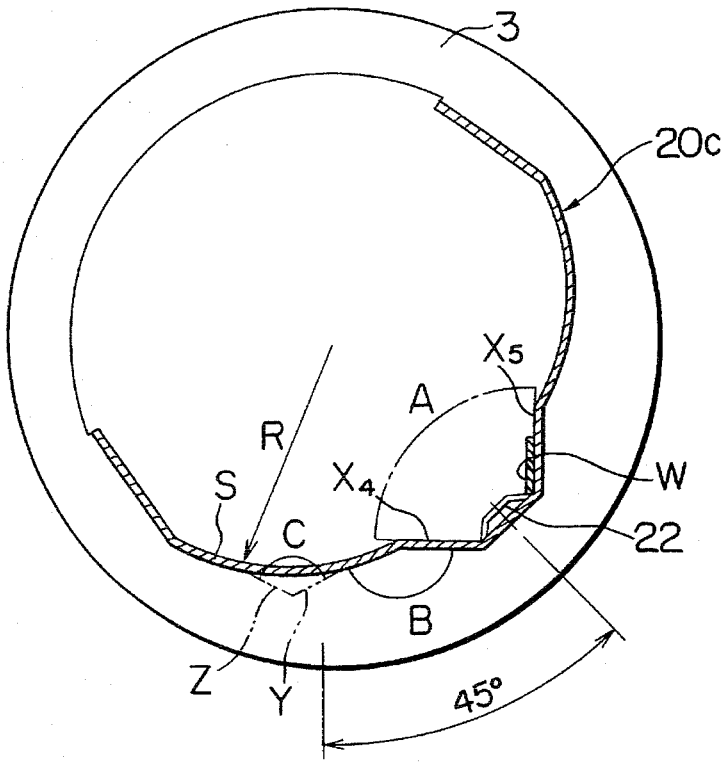
FIG. 5 is a side view of the oscillating trough of FIG. 4 in the state where it is rotated 45°.

In FIG. 4, a portion of the oscillating trough structure 20*c* corresponds to the workpiece transfer portion 2*c* of the first embodiment. In FIG. 4 the trough portion 20*c* is in the normal position, that is, the position before it starts rotating. FIG. 5 shows the trough portion 20*c* rotated counterclockwise through 45°.

The trough portion 20*c* is roughly U-shaped. The trough portion 20*c* includes two surfaces $X_4$, $X_5$, which extend from the bottom 21 of the trough portion 20*c* upwardly and outwardly. The surfaces $X_4$, $X_5$ make an internal angle A of 80°–100° and define a depression 24 in which the workpiece W is turned over. An arcuate surface S is connected to the upper end of each of the surfaces $X_4$, $X_5$. Further, a flat surface 25 is connected to each surface S. The workpiece W in the depression 24 is turned over in the same manner as explained above, and then it falls on the surfaces $X_4$ and S or surfaces $X_5$ and S.

The arcuate surface S will be determined in the following manner. Imaginary planes Y, Z in FIGS. 4 and 5 are drawn, each with a predetermined length. The length is properly determined in view of the diameter of the drum 3 such that the plane Y is within the drum 3. The plane Y at one end intersects the upper edge of the surface $X_4$ or $X_5$ with an external angle B, which is 140°–160°. Preferably, the external angle B is 152°. The plane Z at one end intersects the plane Y with an inner angle C, which is 120°–140°. Preferably, the inner angle C is 127°. The arcuate surface S corresponds to an arc of a radius of 70–100% of the radius of the largest inscribable cylinder with a radius R, inscribed in the imaginary planes Y, Z, and connected to surface $X_4$.

The angles of 140°–160° and 120°–140° were formed to be most effective when the angle A is reduced to 80°–100° and if the position at which these workpieces are turned over is lowered, and these numbers were obtained by repeated experimentation.

These angles B, C and the radius R are deduced frown many experiments in which workpieces of typical shapes such as plates, cubes, and disks are used. As a result of the experiments, it has been found that these workpieces are turned over in the depression 24 and then slip slowly on either arcuate surface S and stop at the center C of the surface S. We tested a trough portion of the same configuration in cross section except that it has angled surfaces Y and Z to turn cubic workpieces over and to cause them to slip onto the angled surfaces Y, Z. It was found that after being turned over in the depression 24 they were turned over again on the surfaces Y, Z, so that the same surfaces of a large number of workpieces lying on the surfaces Y, Z faced in the same direction as when they were in the depression. The upshot was that many workpieces were as if there was no flipping over.

Further, 90–95% of disk-shaped workpieces were turned over in the trough of the present invention, while nearly 50% of the workpieces were turned over in a conventional trough.

As explained above, the trough structure 20*c* has an excellent advantage in that workpieces of various shapes can be effectively turned over.

We claim:

1. An oscillating trough for shotblasting, having a workpiece transfer portion, where workpieces are turned over and transferred downstream to a workpiece discharging portion, wherein the transfer portion includes:

a depression defined by two surfaces $X_4$ $X_5$ extending from the bottom of the transfer portion upwardly and outwardly thereby making an inner angle of 80°–100°; and an arcuate surface S connected to the top of each surface $X_4$ and $X_5$ of the depression, each of the surfaces S corresponding to a curved plane with a radius in cross section of 70–100% of the radius of the largest cylinder inscribable in imaginary planes Y and Z each of a predetermined length, the plane Y at one end intersecting an upper end of the respective surface $X_4$ and $X_5$ with an external angle of 140°–160°, and the plane Z at one end intersecting the plane Y with an inner angle of 120°–140°.

2. The oscillating trough of claim 1, wherein the trough is provided with driving means for rotating the trough about its shaft in two directions, means for detecting the angle of rotation and the rotational speed of the trough, and a controller electrically connected to the detecting means and the driving means for controlling the angle of rotation and the speed of the driving means.

3. The oscillating trough of claim 1, wherein the workpiece discharging portion has a circular cross-section.

4. The oscillating trough of claim 1, wherein the workpiece discharging portion has a semi-circular cross-section.

5. The oscillating trough of claim 1, wherein the workpiece transfer portion has a semi-polygonal cross-section.

6. The oscillating trough of claim 1, wherein the workpiece transfer portion has a U-shaped cross-section.

7. An oscillating trough for shotblasting, comprising:

a depression defined by two surfaces $X_4$ $X_5$ extending from a transfer portion bottom upwardly and outwardly thereby making an inner angle of 80°–100°; and an arcuate surface S connected to the top of each surface $X_4$ $X_5$ of the depression, each of the surfaces S corresponding to a curved plane with a radius in cross section of 70–100% of the radius of the largest cylinder inscribable in imaginary planes Y and Z each of a predetermined length, the plane Y at one end intersecting an upper end of the respective surface $X_4$ and $X_5$ with an external angle of 140°–160°, and the plane Z at one end intersecting the plane Y with an inner angle of 120°–140°.

8. The oscillating trough of claim 7, wherein the trough is provided with driving means for rotating the trough about its shaft in two directions, means for detecting the angle of rotation of the trough and the rotational speed of the trough, and a controller electrically connected to the detecting means and the driving means for controlling the angle of rotation and the speed of the driving means.

* * * * *